US010107045B2

(12) United States Patent
Nakamura et al.

(10) Patent No.: US 10,107,045 B2
(45) Date of Patent: Oct. 23, 2018

(54) DRILLING TOOL

(71) Applicant: MITSUBISHI MATERIALS CORPORATION, Tokyo (JP)

(72) Inventors: Kazuyoshi Nakamura, Anpachi-gun (JP); Hiroshi Ota, Anpachi-gun (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 225 days.

(21) Appl. No.: 15/126,055

(22) PCT Filed: Mar. 10, 2015

(86) PCT No.: PCT/JP2015/057007
§ 371 (c)(1),
(2) Date: Sep. 14, 2016

(87) PCT Pub. No.: WO2015/151737
PCT Pub. Date: Oct. 8, 2015

(65) Prior Publication Data

US 2017/0081923 A1 Mar. 23, 2017

(30) Foreign Application Priority Data

Mar. 31, 2014 (JP) ..... 2014-071558

(51) Int. Cl.
*E21B 10/64* (2006.01)
*E21B 7/20* (2006.01)
(Continued)

(52) U.S. Cl.
CPC ..... *E21B 10/64* (2013.01); *E21B 7/208* (2013.01); *E21B 10/26* (2013.01); *E21B 10/46* (2013.01); *E21B 10/60* (2013.01)

(58) Field of Classification Search
CPC ..... E21B 10/26; E21B 10/64
(Continued)

(56) References Cited

U.S. PATENT DOCUMENTS 2,009,742 A * 7/1935 Mitchell ..... E21B 10/26 175/386
4,819,746 A * 4/1989 Brown ..... E21B 4/14 175/215

(Continued)

FOREIGN PATENT DOCUMENTS

CN 103114812 B 6/2014
CN 203669749 U 6/2014

(Continued)

OTHER PUBLICATIONS

International Search Report dated Jun. 2, 2015, issued for PCT/JP2015/057007 and English translation thereof.

(Continued)

*Primary Examiner* — Shane Bomar
(74) *Attorney, Agent, or Firm* — Locke Lord LLP

(57) ABSTRACT

The drilling tool includes a circular-cylindrical casing pipe; an annular ring bit disposed at a leading end of the casing pipe so as to be coaxial with the casing pipe and rotatable around a central axis of the casing pipe; and a pilot bit inserted into the casing pipe and has a leading end disposed at an inner peripheral part of the ring bit. The ring bit is engaged with the pilot bit in a rotational direction, and thereby is rotatable integrally with the pilot bit and is locked to the leading end of the pilot bit. Drilling tips are mounted on the leading ends of the pilot bit and the ring bit, and first drilling tips at an outermost periphery of the pilot bit and second drilling tips at an innermost periphery of the ring bit overlap each other in a rotational trajectory around the central axis.

6 Claims, 7 Drawing Sheets

(51) Int. Cl.
*E21B 10/26* (2006.01)
*E21B 10/46* (2006.01)
*E21B 10/60* (2006.01)

(58) Field of Classification Search
USPC ..... 175/386
See application file for complete search history.

(56) References Cited

U.S. PATENT DOCUMENTS 5,040,621 A * 8/1991 Lof ..... E21B 7/20
175/171
5,839,519 A * 11/1998 Spedale, Jr. ..... E21B 7/208
175/57

FOREIGN PATENT DOCUMENTS

| | | | |
|---|---|---|---|
| EP | 1837481 | A1 | 9/2007 |
| EP | 2789789 | A1 | 10/2014 |
| JP | 10-054023 | A | 2/1998 |
| JP | 2001-140578 | A | 5/2001 |
| JP | 2008-190287 | A | 8/2008 |
| JP | 4887857 | B2 | 2/2012 |
| JP | 2013-122112 | A | 6/2013 |

OTHER PUBLICATIONS

Office Action dated May 27, 2017, issued for the Chinese patent application No. 201580015073.0 and an English translation of the search report.

* cited by examiner

DRILLING TOOL

TECHNICAL FIELD

The present invention relates to a drilling tool that performs hole drilling with a ring bit that is disposed at a leading end of a casing pipe, and a pilot bit that is inserted into the casing pipe and disposed at the inner peripheral part of the ring bit.

Priority is claimed on Japanese Patent Application No. 2014-071558 filed on Mar. 31, 2014, the contents of which are incorporated herein by reference.

BACKGROUND ART

As such a drilling tool, one in which an annular ring bit is provided at a leading end of a circular-cylindrical casing pipe so as to be rotatable around an axis of the casing pipe, and a pilot bit (inner bit) is attached to a leading end of the transmission member inserted into the casing pipe is known. For example, Patent Document 1 suggests a drilling tool in which first and second abutment parts capable of abutting the casing pipe and the ring bit, respectively, are formed toward a leading end side in an axis direction at the outer periphery of the pilot bit, the pilot bit is engageable with the ring bit around the axis, and the ring bit is removable from the casing pipe to the leading end side in the axis direction.

CITATION LIST

Patent Document

Patent Document 1: Japanese Patent Publication No. 4887857

SUMMARY OF INVENTION

Technical Problem

In such a drilling tool, it is possible to leave the casing pipe and the ring bit within a drilling hole after hole drilling and pull out and recover only the pilot bit. In addition, since the ring bit is removable from the casing pipe to the leading end side, it is also possible to leave only the ring bit within the drilling hole and recover the pilot bit and the casing pipe.

Of course, although it is also possible to recover all of the pilot bit, the casing pipe, and the ring bit from the drilling hole, in any case, the pilot bit is recovered and is then reused for the next hole drilling. Therefore, a lifespan longer than those for the ring bit and the casing pipe is obtained for the pilot bit.

Here, the lifespan of such a pilot bit is usually determined depending on wear of a gauge tip at the outermost periphery of which the amount of drilling becomes greatest because the distance of the gauge tip from the axis is great, among drilling tips that are provided to protrude from a leading end surface of the pilot bit that faces the leading end of the drilling tool from an inner peripheral part of a leading end of the ring bit. That is, in many cases, it is usual that the lifespan of the pilot bit is determined depending on hole drilling speed decreasing due to the wear of this gauge tip or a drilling hole with a predetermined internal diameter not being able to be formed. However, for example, in the drilling tool or the like described in the above Patent Document 1, the leading end surface of the pilot bit protrudes further to the leading end side than the ring bit and hole drilling is performed such that the pilot bit is ahead. Therefore, it is difficult to reduce wear of such a gauge tip or damage thereto.

The invention has been made under such a background, and an object thereof is to provide a drilling tool that can suppress wear of gauge tips at an outermost periphery of a pilot bit, thereby extending the lifespan of a pilot bit to increase the number of times it is reusable and accordingly can contribute to reduction of construction costs and perform efficient hole drilling.

Solution to Problem

In order to solve the above problems to achieve such an object, there is provided a drilling tool including a circular-cylindrical casing pipe; an annular ring bit that is disposed at a leading end of the casing pipe so as to be coaxial with the casing pipe and rotatable around a central axis of the casing pipe; and a pilot bit that is inserted into the casing pipe from a rear end side of the casing pipe and has a leading end disposed at an inner peripheral part of the ring bit. The ring bit is engaged with the pilot bit in a rotational direction during drilling, and thereby is rotatable integrally with the pilot bit around the central axis and is locked to the leading end of the pilot bit in a direction of the central axis, and a plurality of drilling tips are mounted on the leading ends of the pilot bit and the ring bit so as to protrude therefrom, and a first drilling tip positioned at an outermost periphery of the pilot bit and a second drilling tip positioned at an innermost periphery of the ring bit overlap each other in a rotational trajectory around the central axis during drilling.

In such a drilling tool, since the drilling tip, that is, the gauge tip, at the outermost periphery of the pilot bit overlaps the drilling tip at the innermost periphery of the ring bit in the rotational trajectory around the central axis during drilling, a portion of the load that acts on the gauge tip during drilling can be decentralized to the drilling tip at the innermost periphery of the ring bit, and wear of the gauge tip can be suppressed. Therefore, it is possible to extend the lifespan of the pilot bit caused by the wear of such a gauge tip, and as many recovered pilot bits as possible can be reused.

Here, in order to engage the ring bit with the pilot bit in the rotational direction during drilling to make the ring bit rotatable integrally with the pilot bit around the central axis as described above, a protruding strip extending in the direction of the central axis may be formed at an outer periphery of the leading end of the pilot bit, a recessed groove capable of accommodating the protruding strip may be formed at an inner peripheral part of the ring bit, and the pilot bit and the ring bit may be engaged with each other in the rotational direction during drilling by accommodating the protruding strip in the recessed groove.

In such a case, the drilling tip at the outermost periphery of the pilot bit and the drilling tip at the innermost periphery of the ring bit may overlap each other in the rotational trajectory around the central axis during drilling by making a leading end of the protruding strip continuous with a leading end surface of the pilot bit, making the recessed groove open to a leading end surface of the ring bit, mounting the first drilling tip positioned at the outermost periphery of the pilot bit on a leading end of the protruding strip so as to be protruded therefrom, and mounting the second drilling tip positioned at the innermost periphery of the ring bit between openings of the recessed grooves adjacent to each other in a circumferential direction of the ring bit, and is protruded from the leading end of the ring bit.

In addition, in a case where the protruding strip is formed at the outer periphery of the leading end of the pilot bit in this way, the recessed groove capable of accommodating the protruding strip is formed at the inner peripheral part of the ring bit, and the pilot bit and the ring bit are engaged with each other in the rotational direction during drilling, when n ("n" is an integer equal to or greater than 1) recessed grooves are formed at the inner peripheral part of the ring bit, each recessed groove may be formed such that a central angle at which both ends of the recessed groove in the circumferential direction are formed with respect to the central axis falls within a range of 180/n±10(°). According to such a configuration, a situation in which the protruding strip slips out of and disengages from the recessed groove during drilling can be prevented.

Particularly, in such a case, the ring bit may be removable with respect to the pilot bit so as to be separated from the casing pipe to the leading end side in the direction of the central axis. According to such a configuration, a drilling hole can be reliably formed by the pilot bit and the ring bit during drilling. In addition, in a case where the pilot bit and the casing pipe are recovered, with the ring bit being left after a drilling hole is formed to a predetermined depth, the pilot bit and the casing pipe can be pulled out and recovered from the drilling hole as they are without requiring a complicated removal mechanism described in the Patent Document 1. However, in a case where the ring bit is removed together with the pilot bit and the casing pipe, it does not matter even if the ring bit is locked to the casing pipe to the leading end side in the direction of the central axis.

Advantageous Effects of Invention

As described above, according to the invention, the lifespan of the pilot bit can be extended by mitigating the load that acts on the gauge tips at the outermost periphery of the pilot bit, thereby suppressing the wear of the pilot bit, and reduction of construction costs can be promoted and efficient hole drilling can be performed by enabling reuse of more pilot bits.

DESCRIPTION OF EMBODIMENTS

Figure 1:
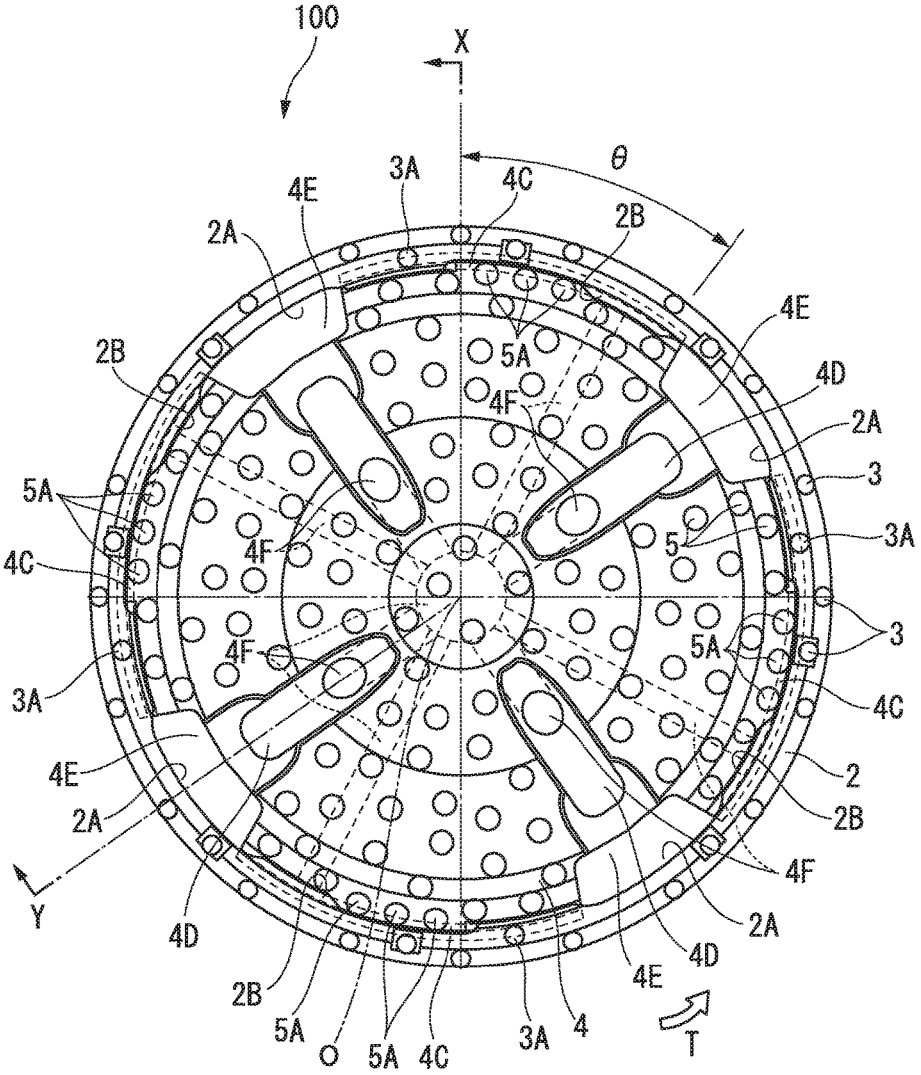
FIG. 1 is a front view illustrating a first embodiment of the invention as seen from a leading end side in a direction of a central axis.
Figure 2:
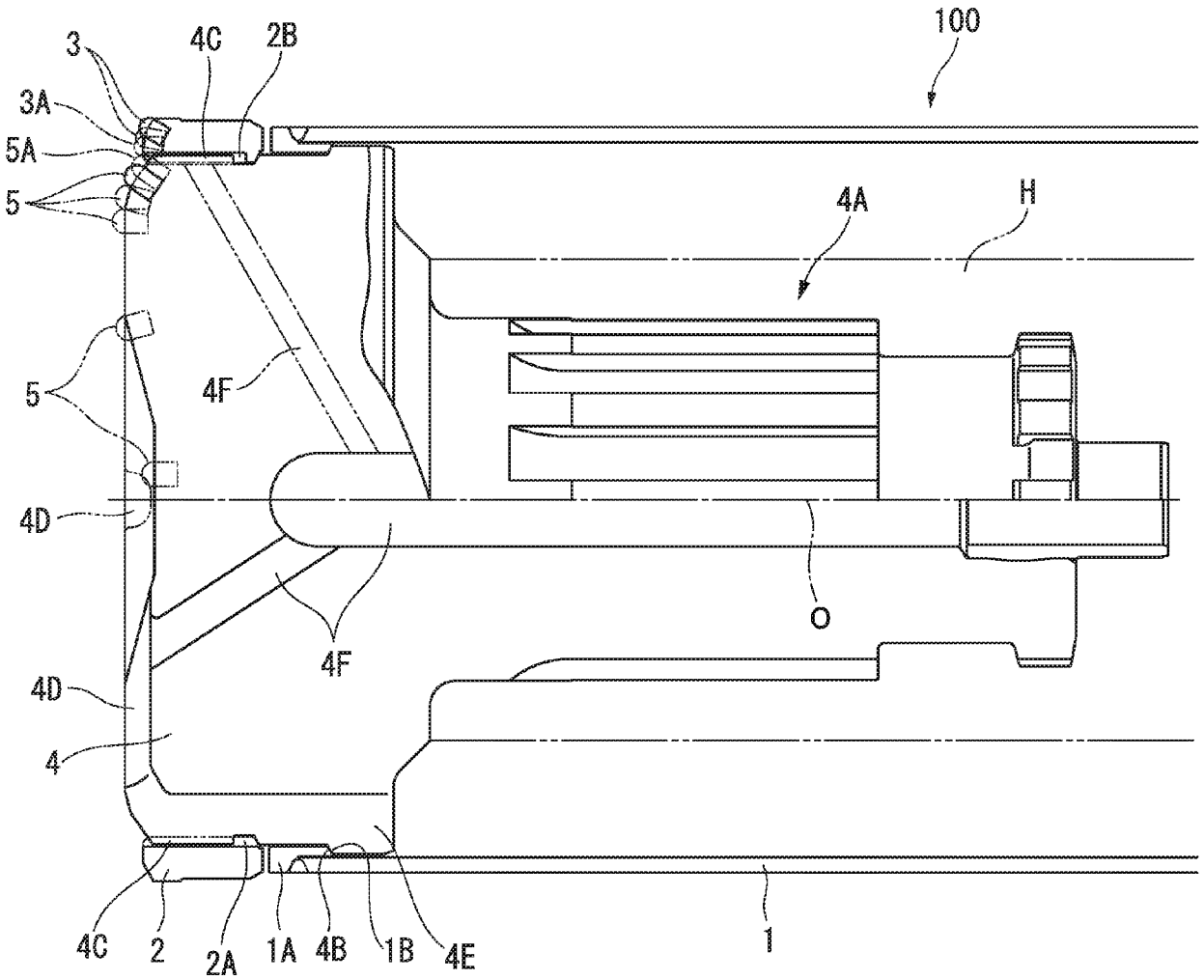
FIG. 2 is a sectional view taken along line XOY in FIG. 1.

FIGS. 1 to 4 are views illustrating a drilling tool 100 of a first embodiment of the invention. As illustrated in FIG. 2, in the present embodiment, a casing pipe 1 is formed in a cylindrical shape centered on a central axis O using a steel material or the like, and a casing top 1A having an external diameter equal to the casing pipe 1 and a slightly smaller internal diameter than the casing pipe 1 is joined and integrally attached to a leading end (in FIG. 2 it is a left portion) of the casing pipe 1 by welding or the like. By attaching such a casing top 1A, a stepped part 1B is formed at an inner periphery of the leading end of the casing pipe 1 such that the internal diameter of the casing pipe 1 becomes one-step smaller toward a leading end side.

An annular ring bit 2 is disposed at a leading end of the casing pipe 1 so as to be coaxial with the casing pipe 1 and rotatable around a central axis O. However, in the present embodiment, the ring bit 2, as illustrated in FIG. 2, is disposed with spacing in the direction of the central axis O from the above casing top 1A, is not coupled with the casing pipe 1 and is removable from the casing pipe 1 to the leading end side in the direction of the central axis O.

The ring bit 2 is also formed of a steel material or the like, and as illustrated in FIG. 2, has a slightly greater external diameter than the casing pipe 1 and a slightly smaller internal diameter than the casing top 1A. In addition, as illustrated in FIG. 1, a plurality of (four in the present embodiment) through-grooves 2A that pass through the ring bit 2 in the direction of the central axis O are formed at equal intervals in a circumferential direction at an inner peripheral part of the ring bit 2 and recessed grooves 2B are formed so as to communicate with the through-grooves 2A, respectively.

The recessed grooves 2B, as are illustrated in FIG. 2, are spaced in the direction of the central axis O from a rear end surface of the ring bit 2, and as illustrated in FIG. 1, extend toward a rotational direction T during drilling to be descried below along the inner peripheral part of the ring bit 2 from the through-grooves 2A that communicate therewith, and are formed so as to be spaced in the circumferential direction from the through-grooves 2A adjacent thereto in the rotational direction T. In addition, the recessed grooves 2B also open to a leading end surface of the ring bit 2.

Here, the width of each recessed groove 2B in the circumferential direction, as illustrated in FIG. 1, is formed such that a central angle at which both ends of the recessed groove 2B in the circumferential direction is formed with respect to the above central axis O falls within a range of 180/n±10(°) when the number of recessed grooves 2B is defined as n and is made to fall within a range of θ=45±10(°) in the present embodiment in which the four recessed grooves 2B are formed. In addition, the width of each through-groove 2A in the circumferential direction is smaller than the width of the recessed groove 2B.

In addition, as illustrated in FIG. 2, a leading end of the ring bit 2 is formed as an inclined surface such that an outer peripheral part thereof is inclined to the rear end side in the direction of the central axis O toward an outer peripheral side, and a flat surface perpendicular to the central axis O is formed on an inner peripheral side with respect to this outer peripheral part. The above through-grooves 2A and the leading ends of recessed grooves 2B open to an inner peripheral side of this flat surface.

A plurality of drilling tips 3 made of a hard material, such as cemented carbide, are embedded in each of the inclined surface and the flat surface of the leading end of the ring bit 2 and in an intersecting ridgeline between the inclined surface and the flat surface, and are provided to protrude therefrom. Moreover, a drilling tip 3A provided to protrude from the flat surface among the drilling tips 3 is disposed such that at a centerline thereof is perpendicular to the flat surface and is located partially on an inner peripheral side with respect to a groove bottom surface facing an inner peripheral side of each recessed groove 2B and is provided to protrude between openings of the above recessed grooves 2B in the circumferential direction of the leading end surface of the ring bit 2.

A pilot bit 4 is inserted into the above casing pipe 1 from the rear end side, and a leading end thereof is disposed at the inner peripheral part of the above ring bit. Here, a transmission member, such as a drilling rod (not illustrated), is added if necessary and inserted into the casing pipe 1 from the rear end side, a hammer H is attached to a leading end of this transmission member, and the pilot bit 4 is attached to the hammer H. The transmission member transmits thrust to the leading end side in the direction of the central axis O and torque around the central axis O in the rotational direction T illustrated in FIG. 1 to the pilot bit 4 during drilling, and the hammer H applies a striking force to the leading end side in the direction of the central axis O to the pilot bit 4.

The pilot bit 4, as illustrated in FIG. 2, has a disk shape such that a rear end thereof is formed as a shank 4A attached to the above hammer H and a leading end thereof is made to have a one-step greater diameter than the shank 4A. An outer periphery of this leading end is formed in multiple steps that that are reduced in diameter in two steps toward the leading end side except for a protruding strip to be described below, the external diameter of the greatest rear step part among these steps is slightly smaller than the internal diameter of the casing pipe 1 and greater than the internal diameter of the casing top 1A, and a stepped part 4B capable of abutting the above stepped part 1B formed at the inner periphery of the leading end of the casing pipe 1 by the casing top 1A from the rear end side is formed at the rear step part.

In addition, a middle step part of the pilot bit 4 on the leading end side with respect to the stepped part 4B is adapted such that the external diameter thereof is slightly smaller than the internal diameter of the casing top 1A and slightly greater than the internal diameter of a portion excluding the through-grooves 2A and the recessed grooves 2B of the ring bit 2, and a leading end surface of this middle step part is enabled to abut the rear end surface of the ring bit 2 from the rear end side. In addition, spacing is formed in the direction of the central axis O described above between the ring bit 2 and the casing top 1A in a state where the leading end surface of the middle step part is made to abut the rear end surface of the ring bit 2 in this way and the above stepped parts 1B and 4B are made to abut each other.

Moreover, the same number of protruding strips 4C as that of the above through-grooves 2A and the recessed grooves 2B are formed at equal intervals in the circumferential direction at an outer periphery of a front step part of the pilot bit 4 on the leading end side with respect to the middle step part, and the external diameter of the front step part excluding the protruding strips 4C is smaller than the internal diameter of the ring bit 2. Each protruding strip 4C is formed at the outer periphery of the leading end so as to protrude with spacing to the leading end side in the direction of the central axis O from the middle step part, and the spacing from the middle step part is slightly greater than the spacing between the rear end surface of the ring bit 2 and each recessed groove 2B.

In addition, an outer peripheral surface of the protruding strip 4C is located on a cylindrical surface centered on the central axis O, and the external diameter of this cylindrical surface is greater than the internal diameter of the ring bit 2 and smaller than the internal diameter of the groove bottom surface that faces inner peripheral sides of each through-groove 2A and each recessed groove 2B. Moreover, the width of the protruding strip 4C in the circumferential direction is smaller than the width of the through-groove 2A, and the protruding strip 4C is enabled to pass through the through-groove 2A in the direction of the central axis O. Furthermore, a leading end surface of the protruding strip 4C is continuous with the leading end surface of the pilot bit 4.

Therefore, if the pilot bit 4 is rotated in the rotational direction T with respect to the ring bit 2 in a state where the protruding strip 4C is passed through the through-groove 2A in this way and the leading end surface of the middle step part is made to abut against the rear end surface of the ring bit 2 described above, the protruding strip 4C is accommodated in the recessed groove 2B such that a portion between the rear end surface of the ring bit 2 and the recessed groove 2B enters a gap portion between the protruding strip 4C of the pilot bit 4 and the leading end surface of the middle step part, and the ring bit 2 is locked to the leading end side of the pilot bit 4 in the direction of the central axis O. Moreover, by rotating the pilot bit 4, the ring bit 2 is engaged with the pilot bit 4 in the rotational direction T and is integrally rotatable with the pilot bit 4, in a place where the protruding strip 4C has abutted the portion between the recessed groove 2B and the through-groove 2A adjacent to the recessed groove in the rotational direction T.

In addition, the leading end surface of the pilot bit 4 is formed so as to protrude to the leading end side slightly from the leading end surface of the ring bit 2, in a state where the ring bit 2 is rotatable integrally with the pilot bit 4 around the central axis O and is locked to the leading end side of the pilot bit 4 in the direction of the central axis O when the ring bit 2 is engaged with the pilot bit 4 in the rotational direction T in this way. The leading end surface of the pilot bit 4 is formed as a flat surface, perpendicular to the central axis O, in which central part thereof located on the above central axis O is recessed to the rear end side, forms an annular flat surface again perpendicular to the central axis O after being gently inclined to the leading end side in the direction of the central axis O, from this flat surface toward the outer peripheral side, and is inclined so as to face the rear end side in the direction of the central axis O also including the leading end surface of the above protruding strip 4C toward the outer peripheral side.

Figure 4:
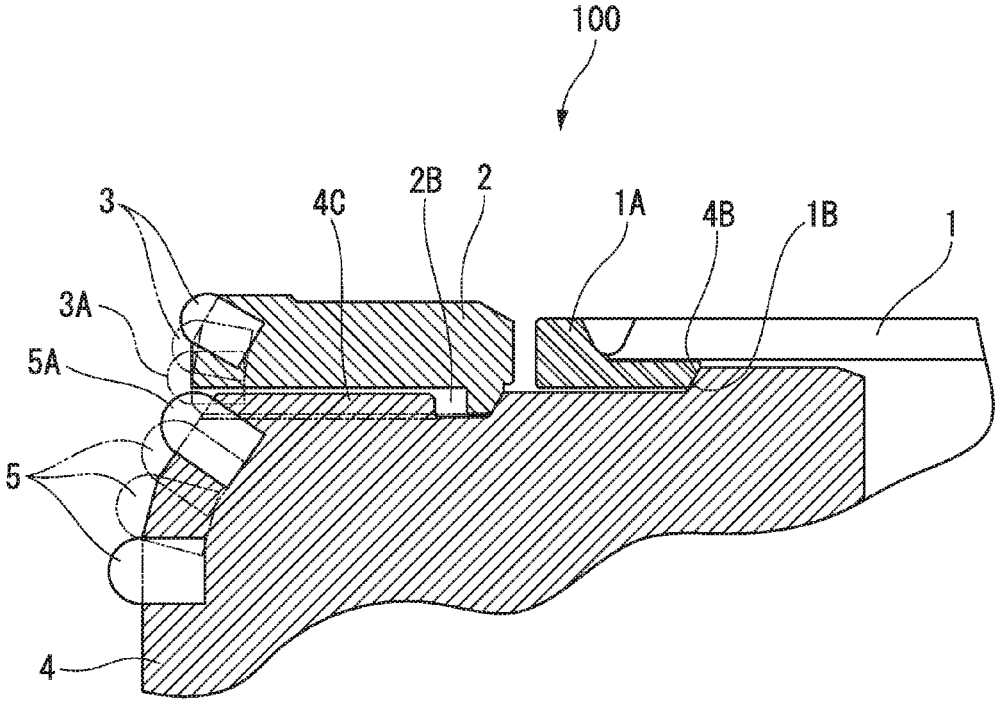
FIG. 4 is a partially enlarged sectional view taken along line XO in FIG. 1.

Furthermore, a plurality of drilling tips 5 made of a hard material, such as cemented carbide, similar to a ring bit 2 are embedded in the leading end surface of the pilot bit 4 and provided to protrude therefrom. Among these dripping tips, drilling tips 5 provided to protrude from a portion inclined so as to face the rear end side in the direction of the central axis O toward an outer peripheral side of an outermost periphery of the leading end surface are formed as gauge tips 5A. Each gauge tip 5A is provided to protrude so as to become perpendicular to the leading end surface of the outermost periphery of which a centerline is inclined, and as illustrated in FIG. 4, is disposed so as to overlap each drilling tip 3A provided to protrude from the flat surface on the inner peripheral side of the leading end surface of the ring bit 2 in a rotational trajectory around the above central axis O.

In addition, the same number of grooves 4D as the protruding strips 4C are formed at equal intervals in the circumferential direction from the above central part toward the outer peripheral side in the leading end surface of the pilot bit 4 so as to radially extend in a radial direction with respect to the central axis O. In addition, outer peripheral ends of the grooves 4D respectively communicate with cuttings grooves 4E that are formed at equal intervals in the circumferential direction so as to pass through the outer periphery of the leading end of the pilot bit 4 in the direction of the central axis O and that are also the same as the number of protruding strips 4C. Each of the cuttings grooves 4E is located at an intermediate portion between the protruding strips 4C adjacent to each other in the circumferential direction and is made to face each through-groove 2A of the ring bit 2, as illustrated in FIG. 1, in a state where the ring bit 2 is engaged with the pilot bit 4 in the rotational direction T and is locked to the leading end side of the pilot bit 4 in the direction of the central axis O, as described above.

Figure 3:
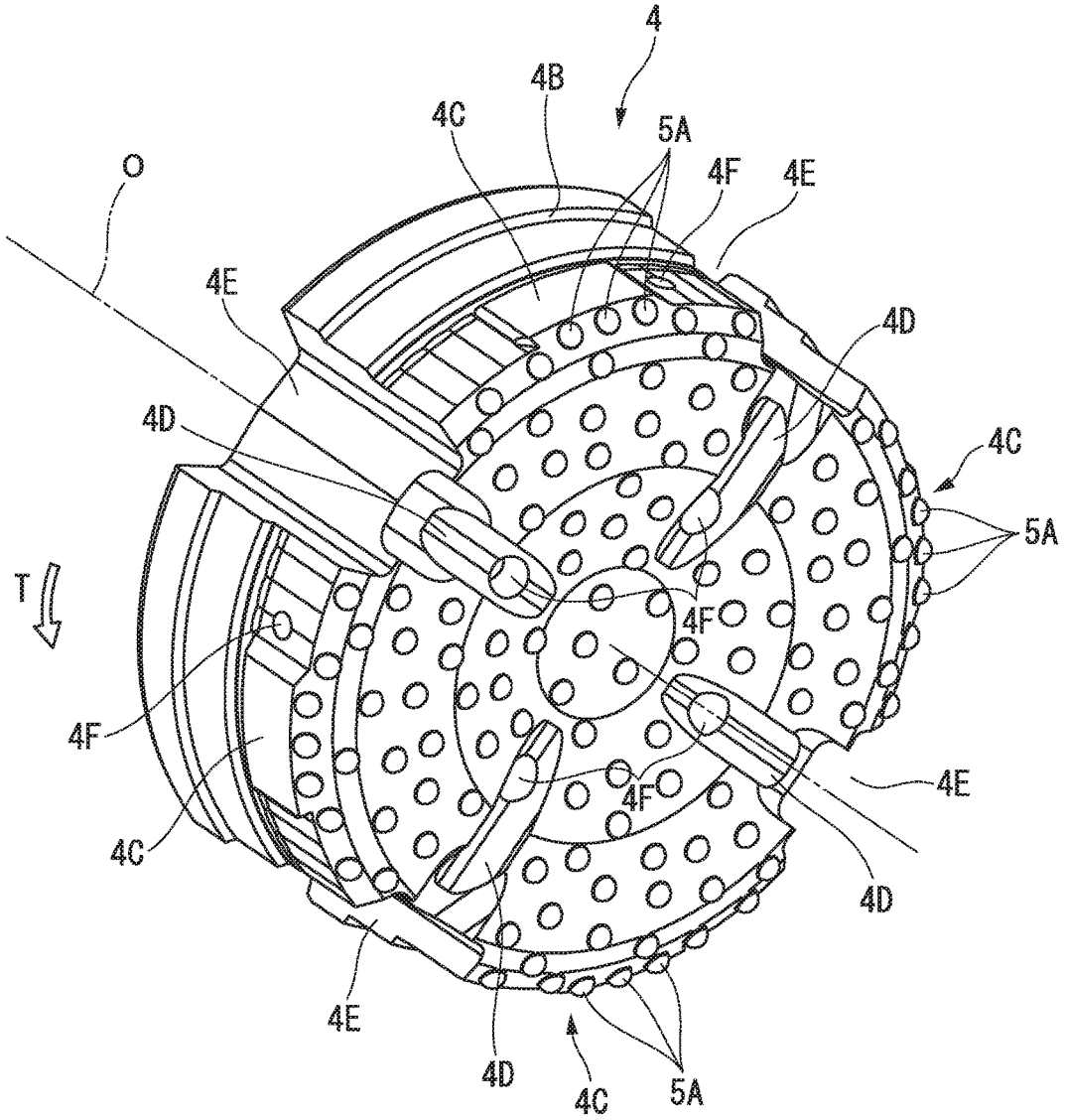
FIG. 3 is a perspective view illustrating a leading end of a pilot bit of the embodiment illustrated in FIG. 1.

As illustrated in FIG. 2, a blow hole 4F is formed within the pilot bit 4 so as to extend into the leading end along the central axis O from a rear end of the shank 4A, and a cuttings-discharging fluid, such as compressed air, are supplied from the above hammer H to the blow hole 4F during drilling. Moreover, the blow hole 4F branches into a plurality of (eight in the present embodiment) hole sections so as to face a leading end outer peripheral side in the leading end of the pilot bit 4, and some (four) of the hole sections open to inner peripheral sides of the above grooves 4D, as illustrated in FIG. 3, the remaining (four) hole sections open to the rear sides of the above protruding strip 4C in the rotational direction T, in the front step part of the outer periphery of the pilot bit 4.

In such a drilling tool, the torque in the rotational direction T and the thrust to the leading end side in the direction of the central axis O are applied via the above transmission member and hammer H and similarly the striking force to the leading end side in the direction of the central axis O is applied from the hammer H, in a state where the ring bit 2 is engaged with the pilot bit 4 in the rotational direction T and is locked to the leading end side of the pilot bit 4 in the direction of the central axis O, as described above. Accordingly, base rock or the like is crushed by the drilling tips 3 and 5 provided to protrude from the leading end surfaces of the ring bit 2 and the pilot bit 4 to form a drilling hole.

In addition, since the stepped part 4B of the pilot bit 4 abuts the stepped part 1B of the inner periphery the leading end of the casing pipe 1 toward the leading end side, the casing pipe 1 is inserted into the drilling hole formed in this way together with the ring bit 2 and the pilot bit 4. Moreover, during drilling, drilling scraps (cuttings) are discharged through the inside of the casing pipe 1 from the cuttings grooves 4E and the through-grooves 2A by the cuttings-discharging fluid jetted from the above blow hole 4F.

In the drilling tool of the above configuration, the gauge tips 5A provided to protrude from the outermost periphery the leading end surface of the pilot bit 4 overlap the drilling tips 3A provided to protrude from the inner periphery of the ring bit 2 in the rotational trajectory around the axis O during drilling. Thus, a portion of a drilling region using the gauge tips 5A can also be drilled by the above drilling tips 3A, and the load to the gauge tips 5A that becomes the greatest in the pilot bit 4 can be decentralized to the above drilling tips 3A of the ring bit 2.

For this reason, the lifespan of the pilot bit 4 can be extended by suppressing wear of the gauge tips 5A. Also, the pilot bit 4 is pulled out and recovered from the inside of the casing pipe 1 with the transmission member and the hammer H after forming the drilling hole to a predetermined depth. In a case where the pilot bit 4 is used for performing the next hole drilling again, it is possible to use the pilot bit 4 more number of times. Therefore, since the drilling tips 5 including a main body of the pilot bit 4 and the gauge tips 5A can be effectively used, hole drilling is efficient and construction cost can be reduced.

In the present embodiment, the protruding strips 4C extending in the direction of the central axis are formed at the outer periphery of the leading end of the pilot bit 4 O, the recessed grooves 2B capable of accommodating the protruding strip 4C are formed at the inner peripheral part of the ring bit 2, and the protruding strips 4C are accommodated in the recessed grooves 2B, so that the ring bit 2 is enabled to engage the pilot bit 4 in the rotational direction T during drilling and integrally rotate the pilot bit 4 around the central axis O. Therefore, since such an engaged state can be maintained by the rotation of the pilot bit 4 and the ring bit 2 during drilling, a situation in which the engagement is released during drilling and the ring bit 2 falls off can be prevented.

Moreover, in the present embodiment, the leading end of the protruding strips 4C are continuous with the leading end surface of the pilot bit 4, and the recessed grooves 2B open to the leading end surface of the ring bit 2. In addition, the gauge tips 5A at the outermost periphery of the pilot bit 4 are provided to protrude from the leading end of the protruding strips 4C, and the drilling tips 3A at the innermost periphery of the ring bit 2 are provided to protrude from the inner periphery of the leading end of the ring bit 2 between the recessed grooves 2B in the circumferential direction, that is, are provided to protrude between the openings of the recessed grooves 2B in the circumferential direction of the above leading end surface of the ring bit 2. For this reason, since the gauge tips 5A can be superimposed on the drilling tips 3A in the above rotational trajectory without impairing the engagement between the pilot bit 4 and the ring bit 2 during drilling by the protruding strips 4C and the recessed groove 2B as described above, hole drilling is much more efficient.

Furthermore, in the present embodiment, when n (n is an integer equal to or greater than 1, four in the present embodiment) recessed grooves 2B are formed at the inner peripheral part of the ring bit 2, each recessed groove 2B is formed with a circumferential width such that the central angle at which both ends of the recessed groove 2B in the circumferential direction is formed with respect to the above central axis O falls within a range of $180/n \pm 10(°)$ ($45 \pm 10(°) = 35°$ to $55°$ in the present embodiment). That is, since approximately ½ of a circumferential width obtained by dividing the circumference of the inner peripheral part of the ring bit 2 by the number of recessed grooves 2B comes the width of each recessed groove 2B, it is possible to much more reliably maintain the engagement between the pilot bit 4 and the ring bit 2 during drilling.

In the present embodiment, the ring bit 2 is engaged with the pilot bit 4 with spacing from the casing pipe 1 (casing top 1A) and is removable from the casing pipe 1 to the leading end side in the direction of the central axis. Therefore, if the pilot bit 4 is rotated in a direction reverse to the rotational direction T during drilling after a drilling hole is formed to the predetermined depth and hold drilling is completed, the protruding strips 4C moves to the positions of the through-grooves 2A from the recessed grooves 2B, and if the pilot bit 4 is pulled out from these positions from the inside of the casing pipe 1 together with the transmission member and the hammer H, the ring bit 2 falls out of the pilot bit 4, and also falls off the casing pipe 1 and is left behind within the drilling hole.

For this reason, in a case where the casing pipe 1 is also pulled out and recovered from the drilling hole, the ring bit 2 having a greater diameter than the casing pipe 1 can prevent the resistance drilling pulling-out from becoming great. In addition, unlike the drilling tool described in the Patent Document 1, the complicated locking means including the removal mechanism that makes the ring bit 2 rotatable around the central axis O with respect to the casing pipe 1, is locked to the casing pipe 1 in the direction of the central axis O, and makes the ring bit removable from the casing pipe to the leading end side is not required.

Even if the ring bit 2 is removable from the casing pipe 1 in this way, in the present embodiment, the engagement between the above protruding strips 4C and the recessed grooves 2B or the central angle θ of the recessed grooves 2B can reliably prevent the ring bit 2 from falling out during drilling.

Figure 5:
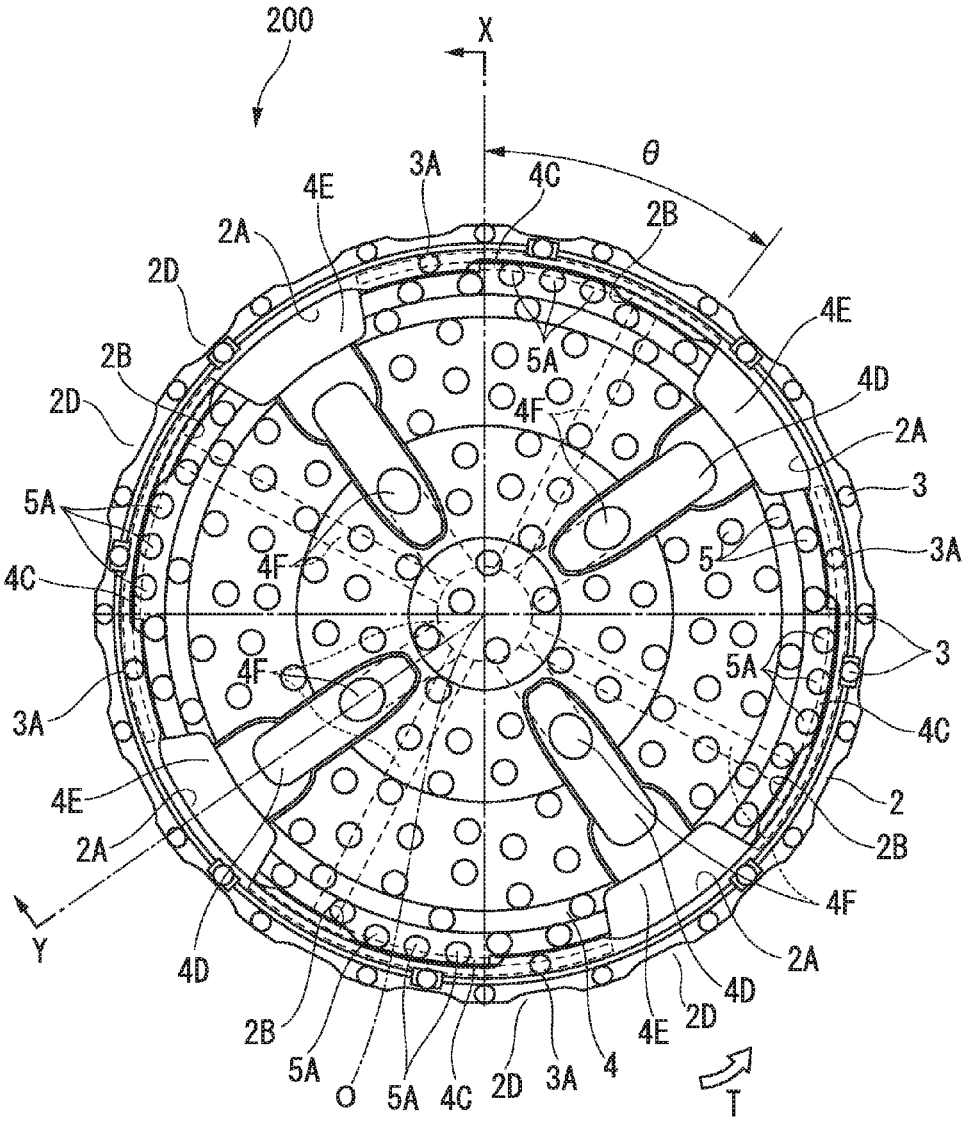
FIG. 5 is a front view illustrating a second embodiment of the invention as seen from the leading end side in the direction of the central axis.

Here, in the first embodiment, the ring bit 2 is removable from the casing pipe 1 in this way. However, as in a drilling tool 200 of a second embodiment of the invention illustrated in FIGS. 5 to 7, the ring bit 2 may be locked to the casing pipe 1 to the leading end side in the direction of the central axis O. In addition, in the second embodiment, the same portions as those of the first embodiment are designated by the same reference signs, and particularly, the casing pipe 1 and the pilot bit 4 excluding the casing top 1A are the same as those of the first embodiment.

That is, in this second embodiment, the outer periphery of the leading end of the casing top 1A extends further to the leading end side than in the first embodiment, and an annular groove 1C that forms an oblong shape in which a section along the central axis O extends in the direction of the central axis O and goes one round around the central axis O is formed at an inner periphery of this extending leading end. The external diameter of a rear end of the ring bit 2 is one-step reduced in diameter with such a size that the ring bit 2 is fittable into the inner periphery of the leading end of the casing top 1A excluding the annular groove 1C, and a locking protrusion 2C with an external diameter such that the locking protrusion can be accommodated in the above annular groove 1C is formed at a rear end outer peripheral part of this rear end that is reduced in diameter.

In addition, the annular groove 1C is formed such that the length thereof in the direction of the central axis O becomes longer than the length of the locking protrusion 2C in the direction of the central axis O. In addition, the locking protrusion 2C may be a protruding strip that goes one round around the rear end outer peripheral part of the ring bit 2, or may be projections with that are dotted in the circumferential direction. Moreover, a plurality of recesses 2D are formed at intervals in the circumferential direction in the outer periphery of the leading end of the ring bit 2 of this second embodiment. In addition, an innermost peripheral part in the leading end surface of the ring bit 2 is gently inclined so as to face the leading end side in the direction of the central axis O toward the outer peripheral side, and drilling tips 3A that are provided to protrude perpendicularly from this innermost peripheral part and that overlap the gauge tips 5A in the rotational trajectory of the pilot bit 4 are inclined slightly to the inner peripheral side as centerlines there of face the leading end side in the direction of the central axis O.

Figure 6:
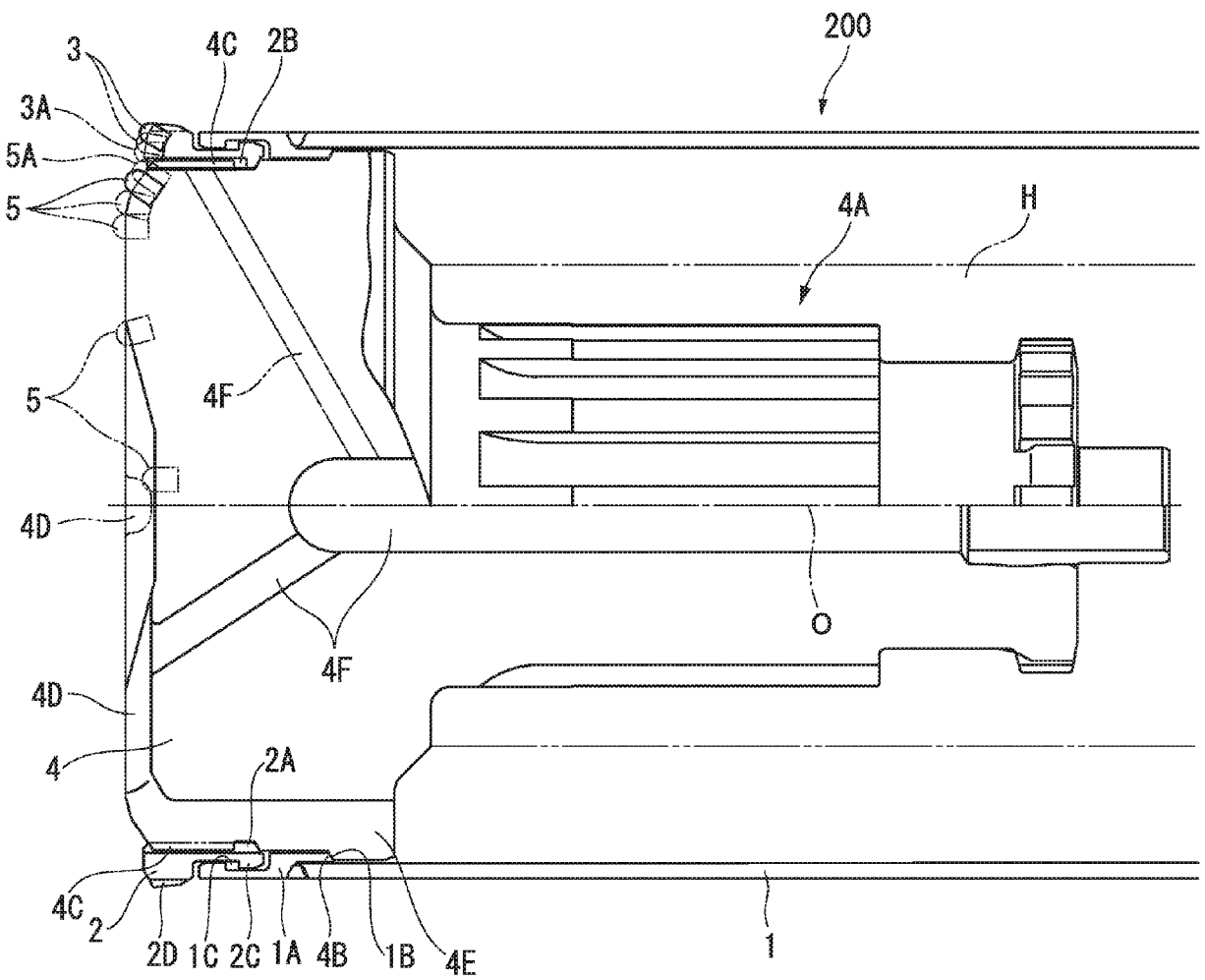
FIG. 6 is a sectional view taken along line XOY in FIG. 5.
Figure 7:
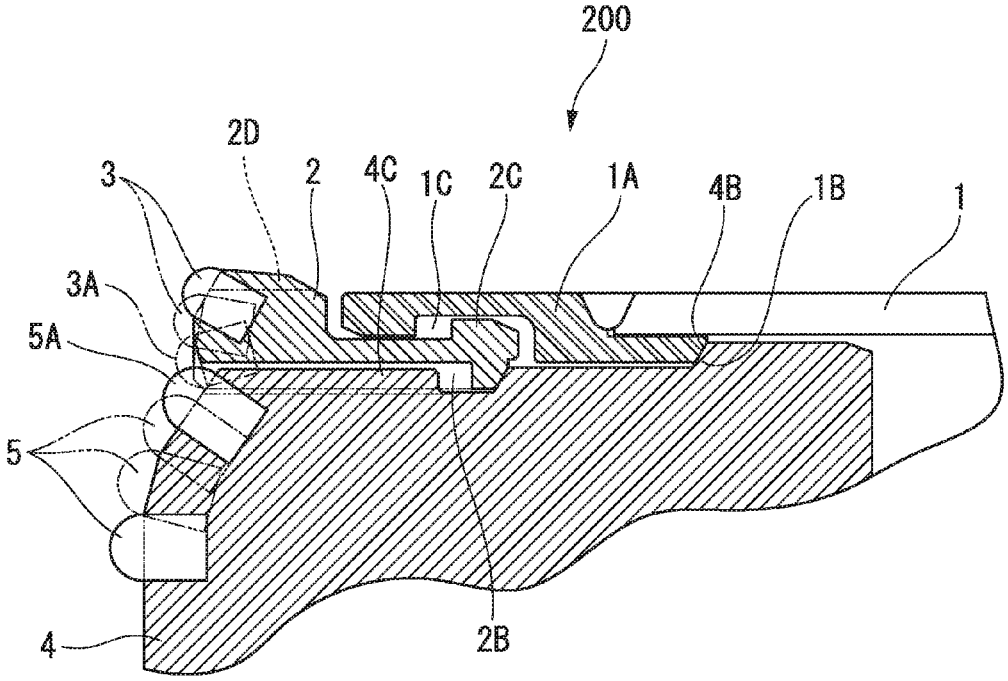
FIG. 7 is a partially enlarged sectional view taken along line XO in FIG. 5.

In such a second embodiment, as illustrated in FIGS. 6 and 7, when the locking protrusion 2C is accommodated in the annular groove 1C and the rear end of the ring bit 2 is fitted into the inner periphery of the leading end of the casing top 1A, and thereby, the ring bit 2 is rotatable around the central axis O with respect to the casing top 1A and the casing pipe 1 and is locked thereto rotation to the leading end side in the direction of the central axis O. For this reason, when the pilot bit 4 is pulled out after a drilling hole is formed similar to the first embodiment, the ring bit 2 does not fall out in the drilling hole, and the ring bit 2 can also be recovered by pulling up the casing pipe 1 from the drilling hole. Thus, it is also possible to reuse the ring bit 2, and consequently, hole drilling is much more efficient.

Here, in the first and second embodiments, as described above, the casing pipe 1 is pulled out from the drilling hole and is recovered. However, only the pilot bit 4 may be recovered, with the casing pipe 1 being also left within the drilling hole together with the ring bit 2. In addition, also in the second embodiment, the ring bit 2 locked to the casing pipe 1 may be removed and be left within a drilling hole by including the same removal mechanism as the drilling tool described in the Patent Document 1.

INDUSTRIAL APPLICABILITY

According to the invention, the lifespan of the pilot bit can be extended by mitigating the load that acts on the gauge tips at the outermost periphery of the pilot bit, thereby suppressing the wear of the pilot bit, and reduction of construction cost can be promoted and efficient hole drilling can be performed by enabling reuse of more pilot bits. Accordingly, the invention has industrial applicability.

REFERENCE SIGNS LIST

1: Casing Pipe
1*a*: Casing Top
2: Ring Bit
2*a*: Through-Groove
2*b*: Recessed Groove
3: Drilling Tip of Ring Bit 2
3*a*: Drilling Tip at Innermost Periphery of Ring Bit 2
4: Pilot Bit
4*c*: Protruding Strip
5: Drilling Tip of Pilot Bit 4
5*a*: Gauge Tip (Drilling Tip at Outermost Periphery of Pilot Bit 4)
O: Central Axis of Casing Pipe 1
T: Rotational Direction of Pilot Bit 4 and Ring Bit 2 during Drilling

The invention claimed is:

1. A drilling tool comprising:

a circular-cylindrical casing pipe;

an annular ring bit that is disposed at a leading end of the casing pipe so as to be coaxial with the casing pipe and rotatable around a central axis of the casing pipe; and a pilot bit that is inserted into the casing pipe from a rear end side of the casing pipe and has a leading end disposed at an inner peripheral part of the ring bit, wherein the ring bit is engaged with the pilot bit in a rotational direction during drilling, and thereby is rotatable integrally with the pilot bit around the central axis and is locked to the leading end of the pilot bit in a direction of the central axis, a plurality of drilling tips are mounted on the leading ends of the pilot bit and the ring bit so as to protrude therefrom, and a first drilling tip positioned at an outermost periphery of the pilot bit and a second drilling tip positioned at an innermost periphery of the ring bit overlap each other in a rotational trajectory around the central axis during drilling.

2. The drilling tool according to claim 1, wherein a protruding strip extending in the direction of the central axis is formed at an outer periphery of the leading end of the pilot bit, a recessed groove capable of accommodating the protruding strip is formed at an inner peripheral part of the ring bit, and the pilot bit and the ring bit are engaged with each other in the rotational direction during drilling by accommodating the protruding strip in the recessed groove.

3. The drilling tool according to claim 2, wherein a leading end of the protruding strip is continuous with a leading end surface of the pilot bit, the recessed groove is open to a leading end surface of the ring bit, the first drilling tip positioned at the outermost periphery of the pilot bit is mounted on a leading end of the protruding strip so as to be protruded therefrom, and the second drilling tip positioned at the innermost periphery of the ring bit is mounted between openings of the recessed grooves adjacent to each other in a circumferential direction of the ring bit, and is protruded from the leading end of the ring bit.

4. The drilling tool according to claim 2, wherein n recessed grooves are formed at the inner peripheral part of the ring bit, each recessed groove is formed such that a central angle at which both ends of the recessed groove in the circumferential direction are formed with respect to the central axis falls within a range of $180/n \pm 10(°)$, wherein "n" is an integer equal to or greater than 1.

5. The drilling tool according to claim 1, wherein the ring bit is removable with respect to the pilot bit so as to be separated from the casing pipe to the leading end side in the direction of the central axis.

6. The drilling tool according to claim 1, wherein the ring bit is locked to the casing pipe to the leading end side in the direction of the central axis.

* * * * *